US012329267B2

(12) United States Patent
Leroux

(10) Patent No.: US 12,329,267 B2
(45) Date of Patent: Jun. 17, 2025

(54) PACKAGING DEVICE FOR A COSMETIC PRODUCT

(71) Applicant: L'OREAL, Paris (FR)

(72) Inventor: Stéphane Leroux, Clichy (FR)

(73) Assignee: L'OREAL, Paris (FR)

( * ) Notice: Subject to any disclaimer, the term of this patent is extended or adjusted under 35 U.S.C. 154(b) by 628 days.

(21) Appl. No.: 17/413,603

(22) PCT Filed: Dec. 19, 2019

(86) PCT No.: PCT/EP2019/086369
§ 371 (c)(1),
(2) Date: Jun. 14, 2021

(87) PCT Pub. No.: WO2020/127777
PCT Pub. Date: Jun. 25, 2020

(65) Prior Publication Data

US 2022/0039540 A1 Feb. 10, 2022

(30) Foreign Application Priority Data

Dec. 19, 2018 (FR) ..... 18 73337

(51) Int. Cl.
*A45D 34/04* (2006.01)
*A45D 40/26* (2006.01)
(Continued)

(52) U.S. Cl.
CPC ..... *A45D 40/267* (2013.01); *A45D 34/046* (2013.01); *B65D 51/32* (2013.01); *B65D 53/02* (2013.01)

(58) Field of Classification Search
CPC .. A45D 40/267; A45D 40/268; A45D 34/046; A45D 34/047
See application file for complete search history.

(56) References Cited

U.S. PATENT DOCUMENTS 3,280,421 A * 10/1966 Davidson ..... A45D 40/267 401/122
3,756,731 A * 9/1973 Aubry ..... A45D 40/267 401/122

(Continued)

FOREIGN PATENT DOCUMENTS

CN 1976846 A 6/2007
CN 103228172 A 7/2013

(Continued)

*Primary Examiner* — Rachel R Steitz
*Assistant Examiner* — Karim Asqiriba
(74) *Attorney, Agent, or Firm* — POLSINELLI PC

(57) ABSTRACT

The invention relates to a packaging device (10) for a cosmetic product comprising: a cosmetic product reservoir (12); a seal (14) mounted fixed on an edge of a reservoir opening (22); and a cover (16) that can be removably assembled to the reservoir in a closed position; said cover comprising a closing element (62) capable of cooperating with the seal to close and seal the opening in the closed position. The seal comprises a tubular skirt (30) for receiving the closing element, said skirt being arranged along an axis (25) passing through the opening in the reservoir and comprising a free edge (38) oriented towards the exterior of said reservoir, the free edge being elastically deformable. The closing element is configured (70) to radially deform the free edge in the closed position.

16 Claims, 2 Drawing Sheets

Figure 1:
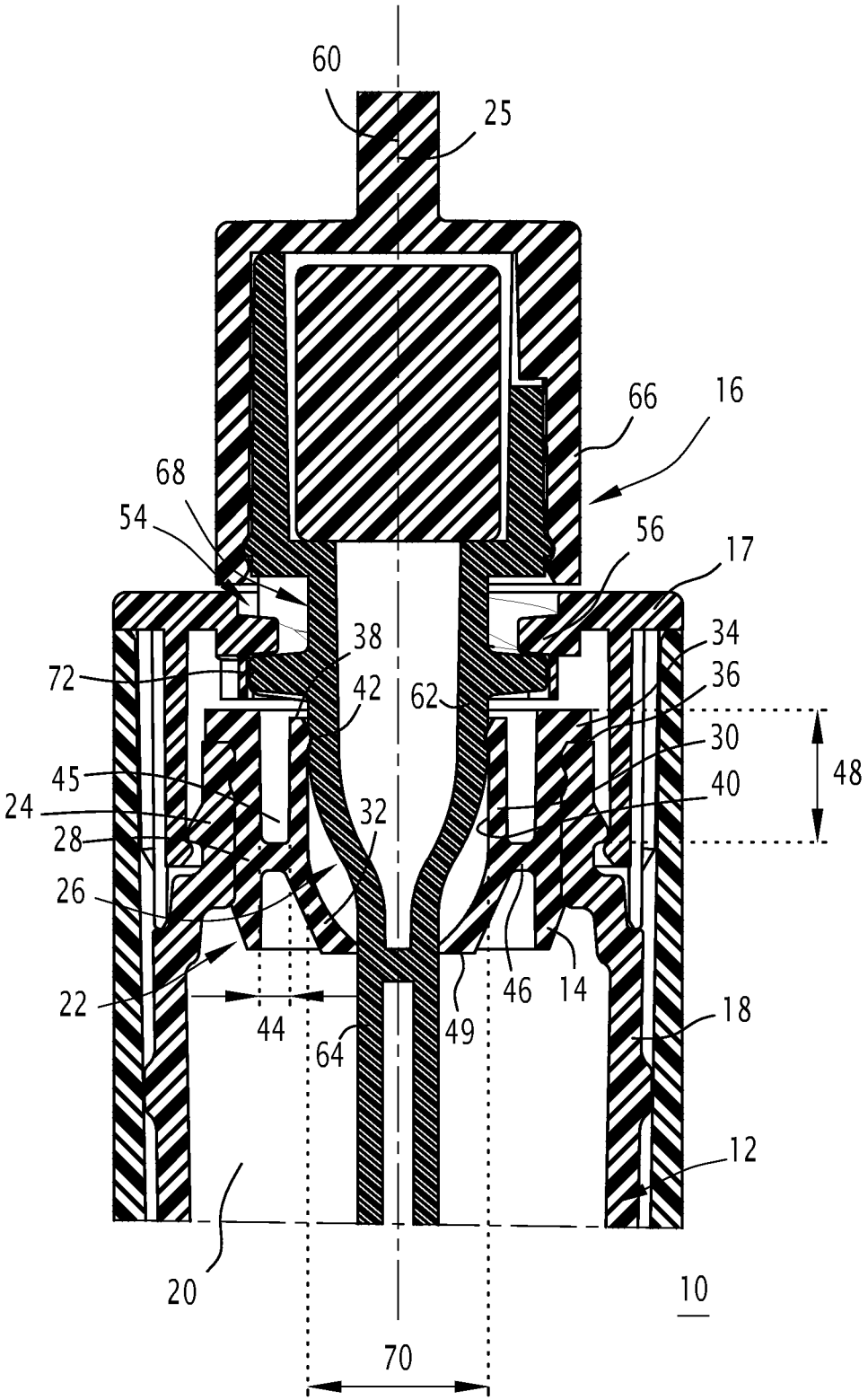

(51) Int. Cl.
*B65D 51/32* (2006.01)
*B65D 53/02* (2006.01)

(56) References Cited

U.S. PATENT DOCUMENTS

| | | | | |
|---|---|---|---|---|
| 6,067,997 | A | 5/2000 | Gueret | |
| 7,695,209 | B2 | 4/2010 | Perignon | |
| 8,287,200 | B2 * | 10/2012 | Chevalier | A45D 40/267<br>401/122 |
| 9,375,072 | B2 | 6/2016 | Drugeon et al. | |
| 10,966,505 | B2 | 4/2021 | Drugeon et al. | |
| 2018/0184785 | A1 | 7/2018 | Jeong et al. | |

FOREIGN PATENT DOCUMENTS

| | | | | |
|---|---|---|---|---|
| EP | 1579784 | A1 | 9/2005 | |
| FR | 2 697 506 | A1 | 5/1994 | |
| FR | 2 968 516 | A1 | 6/2012 | |
| FR | 2978738 | A1 | 2/2013 | |
| FR | 3056386 | A1 | 3/2018 | |
| JP | 3747960 | B2 | 2/2006 | |
| JP | 2013544608 | A | 12/2013 | |
| JP | 2016-064859 | A | 4/2016 | |
| WO | 2013017597 | A1 | 2/2013 | |
| WO | WO2015071328 | * | 5/2015 | |
| WO | WO-2015071328 | A1 * | 5/2015 | A45D 34/045 |

* cited by examiner

PACKAGING DEVICE FOR A COSMETIC PRODUCT

CROSS REFERENCE TO RELATED APPLICATIONS

This application is a National Phase filing under 35 U.S.C. § 371 of PCT/EP2019/086369 filed on Dec. 19, 2019; which application in turn claims priority to Application No. 18 73337 filed in France on Dec. 19, 2018. The entire contents of each application are hereby incorporated by reference.

This invention relates to a packaging device for a cosmetic product of the type comprising: a cosmetic product reservoir, comprising an internal volume and an opening providing access to said internal volume; a seal mounted fixed on an edge of the reservoir opening; and a cover that can be removably assembled to the reservoir in a closed position; said cover comprising a closing element capable of cooperating with the seal to close and seal the opening in the closed position.

The term "cosmetic product", refers, according to this invention, to a product as defined in Regulation (EC) No 1223/2009 of the European Parliament and of the Council of Nov. 30, 2009, on cosmetic products.

Such a cosmetic product packaging device is described in particular in document FR2978738. The reservoir closure is sealed by applying an axial force on the cover, such that the closing element can deform the seal elastically along the radial direction.

However, such a device does not provide full satisfaction. Assembly of the seal with a neck of the reservoir adds a certain stiffness to said joint. Its deformation requires that a relatively high axial force is applied on the cover, which makes the packaging device less comfortable to use.

To solve these problems, the invention relates to a packaging device of the aforementioned type, wherein: the seal comprises a tubular shaped skirt for receiving the closing element, said skirt being arranged along an axis passing through the opening in the reservoir and comprising a free edge oriented towards the exterior of said reservoir, the free edge being elastically deformable in the radial direction relative to said axis; and the closing element is configured to deform said free edge radially in the closed position.

According to further advantageous aspects of the invention, the packaging device comprises one or several of the following features taken in isolation or in any technically possible combination:

- the device is configured such that a free annular space is formed around the skirt in the closed position;
- an internal face of the skirt comprises an annular bead arranged close to the free edge, said annular bead being configured, when in the closed position, to come into contact with and be elastically deformed by the closing element;
- the cover further comprises an application element for a cosmetic product fixed to the closing element, said application element being configured to be placed in the internal volume of the reservoir in the closed position, the seal further comprising a wiping portion for the application element, said wiping portion being axially adjacent to the skirt;
- the edge of the reservoir opening is materialized by a neck substantially coaxial with the skirt, the seal comprising a tubular assembly portion arranged along the axis and inserted in said neck;
- the skirt is radially surrounded by the assembly portion, a non-zero radial distance being arranged between the free edge of said skirt and said assembly portion in the closed position, said skirt and said assembly portion being connected by an internal wall located at a non-zero axial distance from the free edge of the skirt;
- the skirt axially prolongs the assembly portion outside the neck;
- the internal volume of the reservoir receives a quantity of a liquid or cream type fluid cosmetic product, said cosmetic product being preferably selected from a mascara, a nail varnish, a lip gloss, a foundation and a face care composition.

Figure 2:
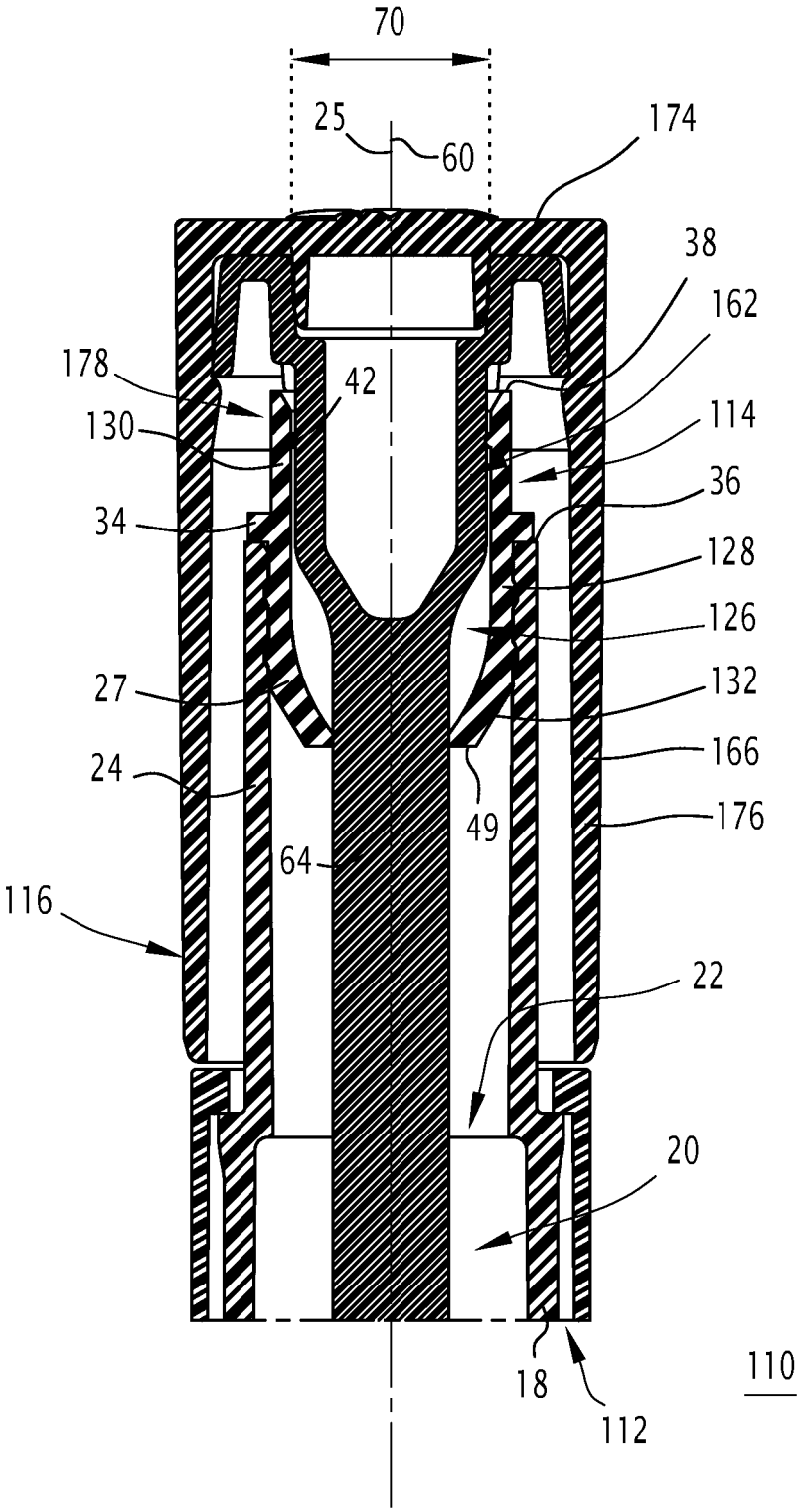

The invention will be easier to understand after reading the following description, provided solely as a non-restrictive example and with reference to the drawings, wherein:

FIG. 1 is a cross-sectional view of a packaging device according to a first embodiment of the invention, and FIG. 2 is a cross-sectional view of a packaging device according to a second embodiment of the invention, FIGS. 1 and 2 show cosmetic product packaging and application devices 10 and 110 respectively, according to first and second embodiments of the invention respectively.

In the following description, the devices 10 and 110 will be described simultaneously, shared elements being designated by the same reference numbers.

The device 10, 110 comprises a reservoir 12, 112, a seal 14, 114 and a cover 16, 116. The device 10 in FIG. 1 further comprises a band 17 integral with the reservoir 12.

On FIGS. 1 and 2, the devices 10 and 110 are represented in a so-called closed position in which the cover 16, 116 is assembled to the reservoir 12, 112 and to the seal 14, 114, as will be described below.

The reservoir 12, 112 is made for example from plastic, metal or glass. The reservoir 12, 112 comprises a wall 18 defining an internal volume 20. Said internal volume 20 can receive a quantity of cosmetic product, particularly in fluid form such as a more or less viscous liquid or a cream. As a variant, the cosmetic product is in the form of a paste or a powder.

In the embodiments shown in FIGS. 1 and 2, the device 10, 110 is more specifically a mascara packaging and application device. As a variant, a device according to the invention is intended particularly for packaging nail varnish, lip gloss, foundation or a face care composition.

The reservoir 12, 112 further comprises an opening 22 providing access to the internal volume 20. The opening is delimited by an edge formed in the wall 18.

In the embodiments represented in FIGS. 1 and 2, the edge of the opening 22 is materialized by a substantially cylindrical neck 24, arranged along a principal axis 25.

The general shape of the seal 14, 114 is tubular along the principal axis 25, defining a conduit 26, 126 open at both ends. The seal 14, 114 is preferably formed of a part made from an elastically deformable material 27.

Said material 27 is for example a natural or synthetic elastomer. As a variant, said material 27 is a polymer material, for example a polyolefin such as Polyethylene (PE) or a thermoplastic polymer such as Polypropylene (PP), polybutylene terephthalate (PBT) or acrylonitrile butadiene styrene (ABS).

"Elastically deformable" means that the material 27 is reversibly flexible and/or stretchable, preferably it is both flexible and stretchable.

The seal 14, 114 comprises an assembly portion 28, 128 and a skirt 30, 130. In the embodiments shown, the seal 14, 114 further comprises a wiping portion 32, 132.

The assembly portion 28, 128 has a tubular shape arranged along the principal axis 25. An external radial portion of said assembly portion 28, 128 has a shape complementary to the internal radial surface of the neck 24. The assembly portion 28, 128 is inserted into the neck 24, said internal and external radial surfaces being in contact with each other. Preferably, the seal 14, 114 further comprises a ring 34 axially adjacent to the assembly portion 28, 128, said ring 34 coming into axial stop against one end 36 of the neck 24.

In the embodiments shown, the neck 24 and the assembly portion 28, 128 have a substantially cylindrical shape of revolution, namely a substantially circular cross-section. However as a variant, said section can have an oval or polygonal shape or any other shape.

The skirt 30, 130 has a tubular shape and it is arranged along the principal axis 25. An axial end of said skirt 30, 130 is formed by a free edge 38. Said free edge also forms a first end of the conduit 26, 126.

In the embodiments shown, the skirt 30, 130 is substantially cylindrical. According to one variant not shown, the skirt is substantially tapered towards the free edge, for example as a truncated cone.

At least at the free edge 38, the skirt 30, 130 is elastically deformable in the radial direction relative to the principal axis 25. "Elastically deformable" means that the skirt 30, 130 can be reversibly folded and/or stretched.

In the embodiments shown in FIGS. 1 and 2, an internal face 40 of the skirt 30, 130 comprises an annular bead 42 arranged close to the free edge 38. The annular bead 42 is elastically deformable in the radial direction relative to the principal axis 25. At rest, the annular bead 42 has a first internal radial dimension.

As a variant not shown, the internal face 40 of the skirt 30, 130 can be smooth and not have an annular bead 42.

In the embodiment shown in FIG. 1, the skirt 30 of the seal 14 is arranged radially inside the assembly portion 28. The free edge 38 of the skirt 30 and the ring 34 are located substantially in the same plane perpendicular to the principal axis 25. A non-zero radial distance 44 is formed between the free edge 38 and the assembly portion 28, defining a first free annular space 45 around the skirt 30.

A second end of the skirt 30, opposite the free edge 38, is connected to the assembly portion 28 by an annular internal partition 46. The internal partition 46 is arranged at a non-zero axial distance 48 from the free edge 38.

In the embodiment shown in FIG. 2, the skirt 130 of the seal 114 axially prolongs the assembly portion 128 starting from the ring 34. More precisely, the skirt 130 forms a projection outside the neck 24 of the reservoir 112, along the principal axis 25. The free edge 38 is opposite the ring 34 along said principal axis.

The wiping portion 32, 132 is tubular and is tapered in shape. More precisely, a transverse dimension of said wiping portion will reduce with increasing distance along the principal axis 25, towards the inside of the reservoir 12, 112. An axial end 49 of the wiping portion 32, 132 with the smallest transverse dimension forms a second end of the conduit 26, 126 opposite the free edge 38 of the skirt 30, 130.

In the embodiment shown in FIG. 1, the wiping portion 32 axially prolongs the skirt 30 starting from the internal partition 46. Said skirt 30 and said wiping portion 32 forming the conduit 26, are arranged inside the assembly portion 28.

In the embodiment shown in FIG. 2, the assembly portion 128 is arranged axially between the skirt 130 and the wiping portion 132. Said skirt 130 and said assembly portion 128 and wiping portion 132 form the conduit 126.

In the embodiment shown in FIG. 1, the band 17 is fixed to the reservoir 12. The band 17 comprises an orifice 54 that axially prolongs the neck 24 starting from its end 36. The orifice 54 is provided with a first assembly element removable with the cover 16, such as a helical pitch 56.

The cover 16, 116 can be assembled removably to the reservoir 12, 112 and to the seal 14, 114 in the closed position in FIGS. 1 and 2.

The cover 16, 116 extends substantially along an axis 60, coincident with the principal axis 25 on FIGS. 1 and 2.

The cover 16, 116 comprises: a closing element 62, 162; an application rod 64; and a gripping element 66, 166. In the embodiment in FIG. 1, the cover 16 further comprises a second removable assembly element 68 that can cooperate with the first removable assembly element 56 of the band 17.

The closing element 62, 162 and the application rod 64 are adjacent along the axis 60. A transverse dimension of the closing element 62, 162 becomes smaller with increasing distance along the direction of the rod 64, starting from the maximum transverse dimension 70. Said maximum transverse dimension is slightly larger than the first internal radial dimension of the annular bead 42 of the skirt 30, 130.

In the embodiments shown, one end of the rod 64 opposite the closing element 62, 162, is assembled to an application member (not shown) of the mascara brush type.

In the closed position shown in FIGS. 1 and 2, the closing element 62, 162 fits into the conduit 26, 126 of the seal 14, 114. At the maximum transverse dimension 70, said closing element 62, 162 is in contact with the annular bead 42 of the skirt 30, 130. Said bead 42 is thus stretched elastically to reach a second inside radial dimension equal to the maximum transverse dimension 70. The free edge 38, close to the bead 42, is also deformed elastically by the closing element 62, 162.

The elastic deformation of the skirt 30, 130, at the free edge 38 and the bead 42, makes it possible to close and to seal the opening 22 to the reservoir 12, 112. The cosmetic product is thus confined in the internal volume 20.

Furthermore, in the closed position represented in FIGS. 1 and 2, the rod 64 passes through the second axial end 49 of the conduit 26, 126 and fits into the internal volume 20 of the reservoir 12, 112.

In the embodiment in FIG. 1, the second removable assembly element 68 is axially adjacent to the closing element 62, 162, opposite the rod 64. Said second removable assembly element 68 comprises a substantially cylindrical segment arranged along the axis 60, and ribs 72 projecting radially from said segment. The ribs 72 can cooperate with the helical pitch 56 of the band 17. More precisely, in the closed position, the second removable assembly element 68 is located in the orifice 54 of the band 17 and the ribs 72 are in contact with the helical pitch 56.

In the embodiment in FIG. 2, the reservoir 112 and the cover 116 are held in the closed position by the radial force applied by the skirt 130 on the closing element 62, 162. According to one variant not shown of the embodiment in FIG. 2, the reservoir 112 and the cover 116 are provided with additional removable means of assembly by translation along the principal axis 25, such as an axial click-fit device.

In the embodiment in FIG. 1, the gripping element 66 is axially adjacent to the second removable assembly element 68, opposite the closing element 62. In the closed position, the gripping element 66 projects in the axial direction from the band 17 so that it can be gripped by a user.

In the embodiment shown in FIG. 2, the gripping element 166 comprises a bottom 174 and a tubular wall 176. The closing element 162 and a part of the rod 64 fit inside said tubular wall 176. One end of said closing element 162, opposite the rod 64, is integral with the bottom 174.

In the closed position, the neck 24 of the reservoir 112 and the skirt 130 of the seal 114 fit inside the tubular wall 176, the skirt 130 being located at a non-zero radial distance from said tubular wall. A second free annular space 178 is thus arranged between said skirt 130 and said tubular wall 176.

A method for using the devices 10 and 110 will now be described. Starting from the closed position in FIGS. 1 and 2, a user grips firstly the reservoir 12, 112 and secondly the cover 16, 116, so as to dissociate said reservoir and said cover from each other.

In the case of the device 10 in FIG. 1, the cover 16 is unscrewed from the reservoir 12 so as to dissociate the ribs 72 from said cover and the helical pitch 56 from the band 17.

In the case of the device 110 in FIG. 1, the cover 116 is dissociated from the reservoir 112 by pulling along the principal axis 25.

The application rod 64 is thus extracted from the reservoir 12, 112. When the application member carried by said rod crosses the end 49 of the wiping element 32, 132, a surplus of cosmetic product is removed from the application member and remains in the internal volume 20.

Said application member is then used to apply the cosmetic product. As a variant, if the cover 16, 116 does not comprise an application member, the cosmetic product is extracted from the reservoir 12, 112 by another means.

The cover 16, 116 is then assembled once again to the reservoir 12, 112, introducing the application member 64 and the rod into the conduit 26, 126 of the seal 14, 114.

In the case of the device 10 in FIG. 1, when the ribs 72 of the cover 16 come into contact with the band 17, a screwing movement is applied on said cover to assemble said ribs with the helical pitch 56. Therefore the closing element 62 is inserted into the skirt 30 with a helical movement.

In the case of the device 110 in FIG. 2, the closing element 162 is inserted in the skirt 130 following a pure axial translation movement along the principal axis 25, or following a helical movement imposed by the user.

During insertion of the closing element 62, 162 in the skirt 30, 130, to the closed position, the free annular space 45, 178 formed around the skirt 30, 130 enables the free edge 38 and the bead 42 to deform and to stretch freely. This assures a sealed closure of the reservoir 12, 112.

The device 10, 110 according to the invention confers a better radial deformation amplitude on the free edge 38 and the bead 42 than is possible with known devices, due to the free annular space 45, 178 around the skirt 30, 130. Deformation of said skirt becomes more supple, which improves comfort of the user during assembly and dissociation of the reservoir 12, 112 and the cover 16, 116.

In particular, the reservoir 112 and the cover 116 can be assembled by a purely axial translation movement so that the seal obtained at the seal 114 is satisfactory. In particular, there is no need to impose a helical movement on the cover 116 during assembly.

Thus, there is no need to configure the skirt 130 and the closing element 162 with a circular cross-section, which allows greater freedom with design of the product. In particular, oval or polygonal sections can be envisaged.

Furthermore, the sealing function and the reservoir 12, 112 attachment function depend on different portions of the seal 14, 114 of the skirt 30, 130 and the assembly portion 28, 128, respectively. Therefore the sizing of said seal is governed by technical constraints, which facilitates its manufacturing.

As indicated above, the packaging device can be fitted with axial assembly means between the reservoir and the cover, such as click fit elements.

However, the invention does not exclude devices assembled by a helical movement, such as the previously described device 10.

Similarly, according to one variant of the invention, the packaging device comprises means of assembling the reservoir and the cover by means of an axial translation movement, followed by a rotation movement, such as a bayonet device.

The invention claimed is:

1. A packaging device for a cosmetic product, comprising:

a cosmetic product reservoir, comprising an internal volume and an opening providing access to said internal volume;

a seal, mounted fixed on an edge of the opening; and a cover, that can be removably assembled to the reservoir in a closed position;

said cover comprising a closing element capable of cooperating with the seal so as to close and seal the opening in the closed position;

the device wherein:

the seal comprises a tubular shaped skirt for receiving the closing element, said skirt being arranged along an axis passing through the opening of the reservoir and comprising a free edge oriented towards the exterior of said reservoir, the free edge being elastically deformable in the radial direction relative to said axis;

wherein the closing element is configured to radially deform said free edge in the closed position; and the packaging device is configured such that a free angular space is formed around the skirt in the closed position, so as to enable the free edge to radially stretch during insertion of the closing element in the skirt to the closed position, for ensuring a sealed closure of the cosmetic product reservoir;

wherein an internal face of the skirt comprises an annular bead arranged close to the free edge, said annular bead being configured, when in the closed position, to come into contact with and be elastically deformed in the radial direction by the closing element.

2. The packaging device according to claim 1, wherein the cover further comprises an application element for the cosmetic product, fixed to the closing element, said application element being configured to be placed in the internal volume of the reservoir in the closed position, the seal further comprising a wiping portion for the application element, said wiping portion being axially adjacent to the skirt.

3. The packaging device according to claim 2, wherein the edge of the reservoir opening is materialized by a neck extending along the axis passing through the opening, between the edge of the opening and an end; the seal comprising a tubular assembly portion arranged along the axis and inserted in said neck.

4. The packaging device according to claim 3, wherein the seal further comprises a ring axially adjacent to the assembly portion, said ring coming into axial stop against the end of the neck.

5. The packaging device according to claim 2, wherein the internal volume of the reservoir-receives a quantity of a liquid or cream type fluid cosmetic product.

6. The packaging device according to claim 1, wherein the edge of the reservoir opening is materialized by a neck extending along the axis passing through the opening, between the edge of the opening and an end; the seal comprising a tubular assembly portion arranged along the axis and inserted in said neck.

7. The packaging device according to claim 6, wherein the seal further comprises a ring axially adjacent to the assembly portion, said ring coming into axial stop against the end of the neck.

8. The packaging device according to claim 1, wherein the skirt is radially surrounded by an assembly portion, a non-zero radial distance being arranged between the free edge of said skirt and said assembly portion in the closed position, said skirt and said assembly portion being connected by an internal wall located at a non-zero axial distance from the free edge of the skirt.

9. The packaging device according to claim 8, wherein the internal volume of the reservoir-receives a quantity of a liquid or cream type fluid cosmetic product.

10. The packaging device according to claim 8, wherein the seal further comprises a ring axially adjacent to the assembly portion, said ring coming into axial stop against the end of the neck.

11. The packaging device according to claim 1, wherein the skirt axially prolongs an assembly portion outside a neck.

12. The packaging device according to claim 11, wherein the internal volume of the reservoir-receives a quantity of a liquid or cream type fluid cosmetic product.

13. The packaging device according to claim 1, wherein the internal volume of the reservoir receives a quantity of a liquid or cream type fluid cosmetic product.

14. The packaging device according to claim 1, wherein the cover further comprises an application element for the cosmetic product, fixed to the closing element, said application element being configured to be placed in the internal volume of the reservoir in the closed position, the seal further comprising a wiping portion for the application element, said wiping portion being axially adjacent to the skirt.

15. The packaging device according to claim 1, wherein the edge of the reservoir opening is materialized by a neck extending along the axis passing through the opening, between the edge of the opening and an end; the seal comprising a tubular assembly portion arranged along the axis and inserted in said neck.

16. The packaging device according to claim 1, wherein the internal volume of the reservoir-receives a quantity of a liquid or cream type fluid cosmetic product.

* * * * *